US005755301A

United States Patent [19]

Love et al.

[11] Patent Number: 5,755,301

[45] Date of Patent: May 26, 1998

[54] INSERTS AND COMPACTS WITH LEAD-IN SURFACE FOR ENHANCED RETENTION

[75] Inventors: Raymond Joseph Love, Lewisville; Harry Morales Campos, Jr., Grand Prairie, both of Tex.

[73] Assignee: Dresser Industries, Inc., Dallas, Tex.

[21] Appl. No.: 700,656

[22] Filed: Aug. 9, 1996

[51] Int. Cl.[6] ..... E21B 10/52

[52] U.S. Cl. ..... 175/426

[58] Field of Search ..... 175/331, 374, 175/426, 432

[56] References Cited

U.S. PATENT DOCUMENTS

| | | | |
|---|---|---|---|
| 2,038,386 | 4/1936 | Scott et al. | 175/353 |
| 2,148,372 | 2/1939 | Garfield | 175/341 |
| 2,571,930 | 10/1951 | Noble | 175/353 |
| 2,687,875 | 8/1954 | Morlan et al. | 175/374 |
| 3,034,589 | 5/1962 | Hagstrom | 175/420.1 |
| 3,134,447 | 5/1964 | McElya et al. | 175/332 |
| 3,137,355 | 6/1964 | Schumacher, Jr. | 175/374 |
| 3,250,337 | 5/1966 | Demo | 175/343 |
| 3,389,761 | 6/1968 | Ott | 175/374 |
| 3,442,342 | 5/1969 | McElya et al. | 175/374 |
| 3,461,983 | 8/1969 | Hudson et al. | 175/375 |
| 3,495,668 | 2/1970 | Schumacher, Jr. | 175/341 |
| 3,599,737 | 8/1971 | Fischer | 175/374 |
| 3,603,414 | 9/1971 | Stebley | 1475/426 X |
| 3,749,190 | 7/1973 | Shipman | 175/426 |
| 4,047,583 | 9/1977 | Dyer | 175/426 |
| 4,077,734 | 3/1978 | Kita | 175/426 X |
| 4,086,973 | 5/1978 | Keller et al. | 175/374 |
| 4,176,725 | 12/1979 | Shields | 175/374 |
| 4,254,840 | 3/1981 | Shay, Jr. | 175/426 |
| 4,271,917 | 6/1981 | Sahley | 175/426 |
| 4,406,337 | 9/1983 | Dill | 175/426 |
| 4,420,050 | 12/1983 | Jones | 175/374 |
| 4,595,067 | 6/1986 | Drake | 175/331 |
| 4,597,456 | 7/1986 | Ecer | 175/371 |
| 4,660,660 | 4/1987 | Yuh | 175/426 |
| 4,716,977 | 1/1988 | Huffstutler | 175/426 |
| 5,201,376 | 4/1993 | Williams | 175/374 |
| 5,322,138 | 6/1994 | Siracki | 175/374 |
| 5,421,423 | 6/1995 | Huffstutler | 175/374 |

FOREIGN PATENT DOCUMENTS

| | | |
|---|---|---|
| 244980 | 4/1969 | U.S.S.R. . |
| 309110 | 7/1971 | U.S.S.R. . |
| 1488427 | 6/1989 | U.S.S.R. . |

OTHER PUBLICATIONS

Security, *Security Double Seal Bits*, undated, 5 pages.

Security/Dresser, *New HF-148 Tooth Hardfacing*, Jun. 1990, 4 pages.

J.W. Langford and M.S. Kaisi, *Field Performance of Hydrodynamically Lubricated Bearing Seal for Rock Bits*, paper prepared for presentation at the 1990 IADC/SPE Drilling Conference, 10 pages.

Security/Dresser, *Rock Bit Technology Manual*, undated, 61 pages.

*Primary Examiner*—David J. Bagnell

*Attorney, Agent, or Firm*—Baker & Botts,L.L.P.

[57] ABSTRACT

An improved insert for use in a drilling device. The insert adapted to be mounted on the drilling device within a socket formed in the drilling device. The insert has a convex curved lead-in surface formed on the lower portion of the insert. The lead-in surface operates to enhance the retention of the insert within the socket during drilling operations.

17 Claims, 3 Drawing Sheets

INSERTS AND COMPACTS WITH LEAD-IN SURFACE FOR ENHANCED RETENTION

TECHNICAL FIELD OF THE INVENTION

This invention relates generally to drill bits and other types of downhole equipment having inserts and compacts to gouge, scrape and/or crush the bottom of a borehole or to prevent erosion, abrasion and/or wear of surfaces exposed to downhole fluids. More particularly, this invention relates to the structure of drill bit inserts to enhance their retention within a corresponding socket during downhole drilling operations.

BACKGROUND OF THE INVENTION

One type of drill bit used in drilling a borehole in the earth is a roller cone rock bit. In one type of roller cone rock bit, the cutters each have a generally cone shaped body with a plurality of hard material cutting elements, referred to as inserts or compacts, protruding from the surface of the body. As the bit is rotated under weight against the earth, the inserts penetrate rock in a gouging, scraping action to chip away formation material and form a borehole. The cutting inserts and compacts are usually formed from a hard, abrasion-resistant material such as sintered and compacted tungsten carbide. Typically, such cutting inserts or compacts have cylindrical body with a generally frustoconical cutting portion. The cylindrical body is fitted into a socket, which is drilled into the exterior of the roller cone cutter, such that the cutting portion protrudes from the exterior of the associated cone cutter. The insert or compact is typically held in the socket due to the interference force between the insert or compact and the socket. A cone cutter can also include a variety of other elements, such as buttons, that can be installed into a socket and retained by means of an interference fit.

To provide an interference fit between the insert or compact and the socket, the socket is formed with a diameter slightly smaller than that of the cylindrical body of the insert. The insert or compact is then pressed into the socket and retained by the contact force between the socket wall and the surface of the cylindrical body of the insert or compact. Because the insert diameter exceeds that of the socket and because of the hardness of the insert material, the installation operation (pressing the insert into the socket) can be difficult and can damage the socket. A damaged socket can reduce the contact force between the insert and the socket wall. If the socket becomes sufficiently damaged during installation, the insert can dislodge from the socket during drilling operations. A damaged socket can also allow the insert to rotate in the socket during drilling, which can decrease the cutting effectiveness of the insert.

In an attempt to address these problems, flat-bottomed inserts have had a straight lead-in chamfer surface formed onto the bottom portion of the cylindrical body. Conventional straight lead-in chamfer surfaces are typically formed such that the lead-in chamfer surface has a 15 degree angle relative to the cylindrical body surface. While straight lead-in chamfers can prevent some damage to the socket during insert installation, the straight lead-in chamfer does not eliminate these problems. Furthermore, grinding the cylindrical surface of the compact can result in a defect, such as a lift or a lip, at the intersection between the cylindrical body and the lead-in chamfer surface. This defect can score or otherwise damage the socket wall during installation and can cause shearing as the insert is pressed into the socket. This damage can weaken the retention force between the socket wall and the insert and can lead to dislodging of the insert from the socket. In an attempt to prevent damage to the socket wall caused by these raised defects, a "tumbling" process can be performed on the inserts to remove any raised or sharp edges created by grinding the compact's cylindrical surface. The tumbling process is followed by a cleaning process to clean the inserts. The tumbling and cleaning processes represent additional manufacturing steps.

U.S. Pat. No. 5,201,376 to Mark E. Williams discloses a cutter insert having an improved cutting surface. The inserts are press-fitted into respective sockets formed in the associated cone cutter. While the patent does not specifically discuss the press-fit installation operation or the shape of the bottom of the insert, FIGS. 5, 7 and 8 show the insert having a straight lead-in chamfer. This type of straight, single-angle lead-in chamfer incorporates all of the limitations previously discussed.

SUMMARY OF THE INVENTION

In accordance with the present invention, disadvantages and problems associated with previous inserts and compacts have been substantially reduced or eliminated.

One aspect of the present invention includes providing a drill bit insert having a lead-in surface, defined by a lead-in radius, on the lower portion of the insert to allow easier installation of the insert within its associated socket.

The present invention provides an important technical advantage by providing a smoother transition during installation of the insert into the socket. The curved lead-in surface, defined by the lead-in radius, provides for a smoother transition of the insert into the socket to reduce the likelihood of damage to the socket during installation.

The present invention provides another technical advantage by enhancing the retention of the insert within the socket. By reducing damage to the socket, the present invention more effectively maintains the integrity of the socket, resulting in enhanced retention of the insert within the socket.

The present invention provides still another technical advantage by increasing the ease of removal of an insert from a mold during manufacture. The lead-in surface of the insert can provide a better draft to ease the removal of an insert from the mold.

The present invention's use of a sufficiently large lead-in radius to define the shape of the lead-in surface provides yet another technical advantage by forming a smaller transition from the cylindrical body to the lead-in surface. This smaller transition will reduce both the occurrence and the size of defects, such as steps or lips, at the intersection point between the cylindrical body and the lead-in radius that can interfere with the installation, retention, and removal of the inserts. By eliminating these transition area defects, the present invention also eliminates the need to perform a tumbling process, and the subsequent cleaning process, on the inserts to remove protrusions and sharp edges.

BRIEF DESCRIPTION OF THE DRAWINGS

For a more complete understanding of the present invention, and the advantages thereof, reference is now made to the following description taken in conjunction with the accompanying drawings, in which.

DETAILED DESCRIPTION OF THE INVENTION

The preferred embodiments of the present invention and its advantages are best understood by referring to FIGS. 1 through 8 of the drawings, like numerals being used for like and corresponding parts of the various drawings.

Figure 1:
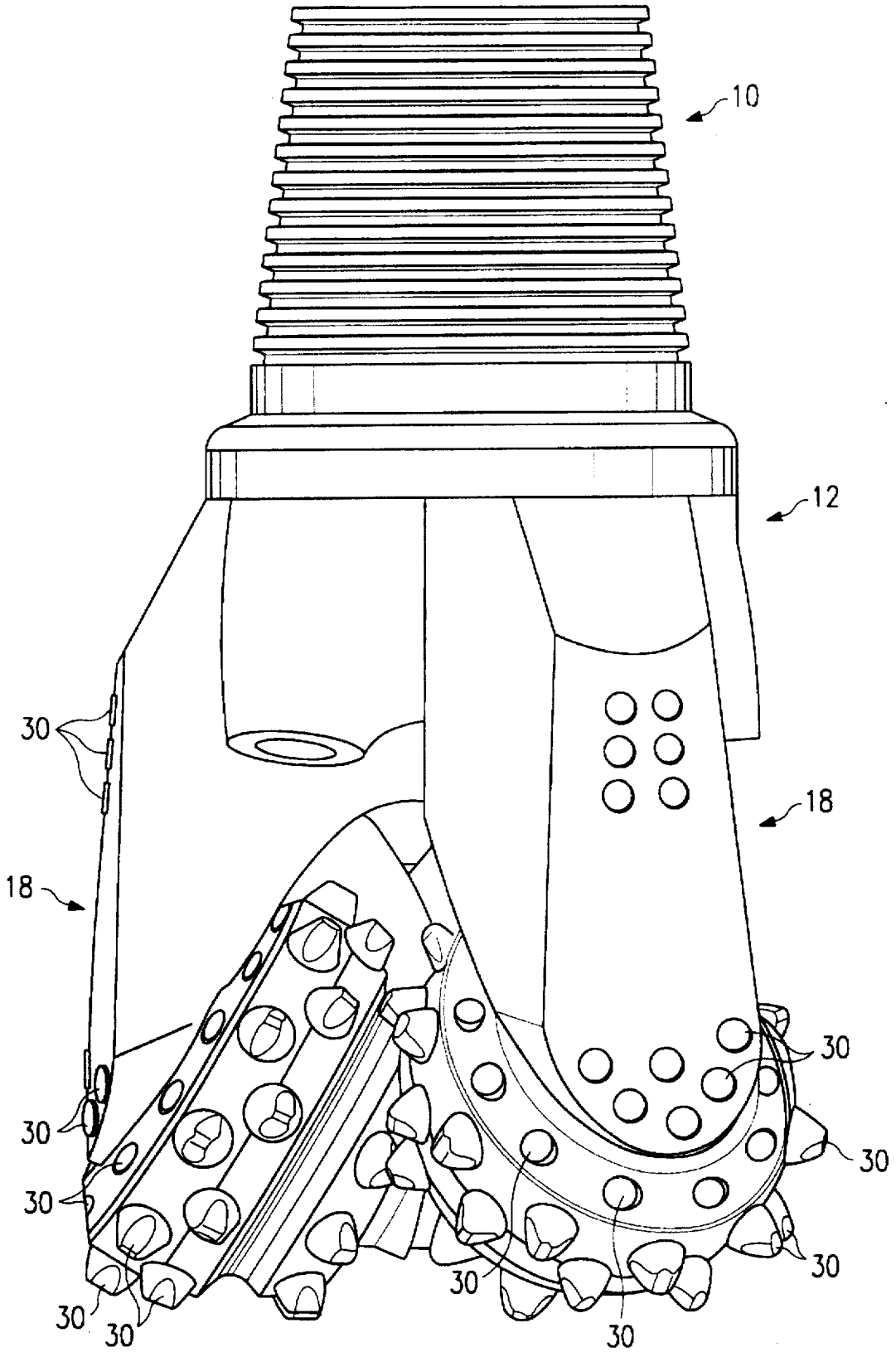
FIG. 1 is a schematic drawing showing an isometric view of a rotary cone drill bit with inserts incorporating various teachings of the presenting invention.
Figure 2:
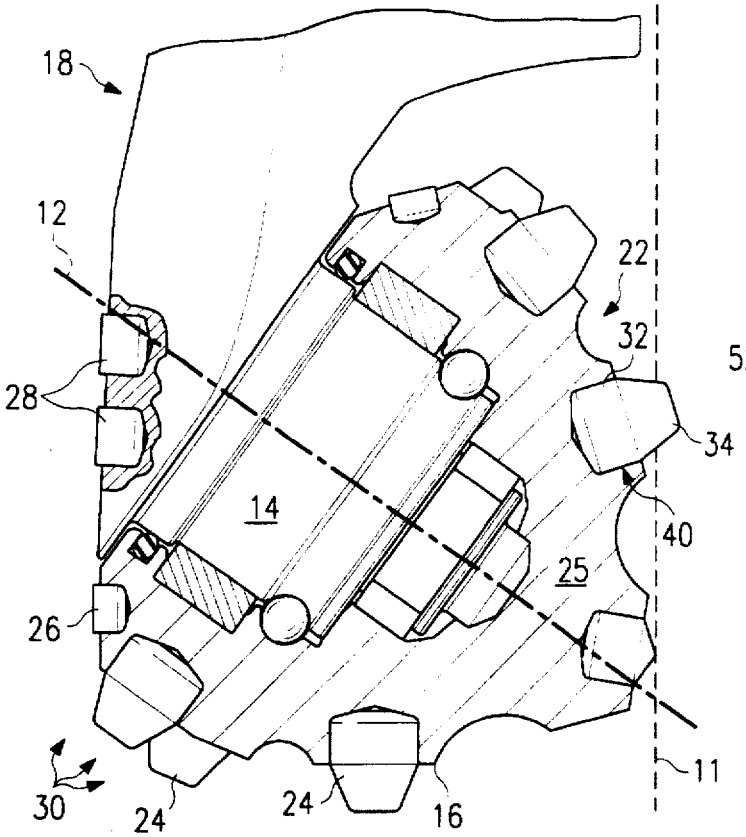
FIG. 2 is a schematic drawing partially in section and partially in elevation with portions broken away showing a support arm and cutter cone assembly for the rotary cone drill bit from FIG. 1 having inserts and compacts installed within corresponding sockets in accordance with the teachings of the present invention.
Figure 3:
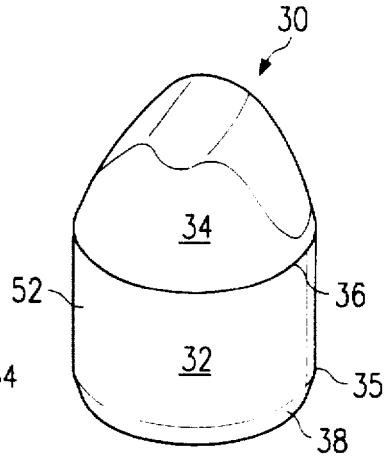
FIG. 3 is a schematic drawing showing an isometric view of an insert incorporating the teachings of the present invention.
Figure 6:
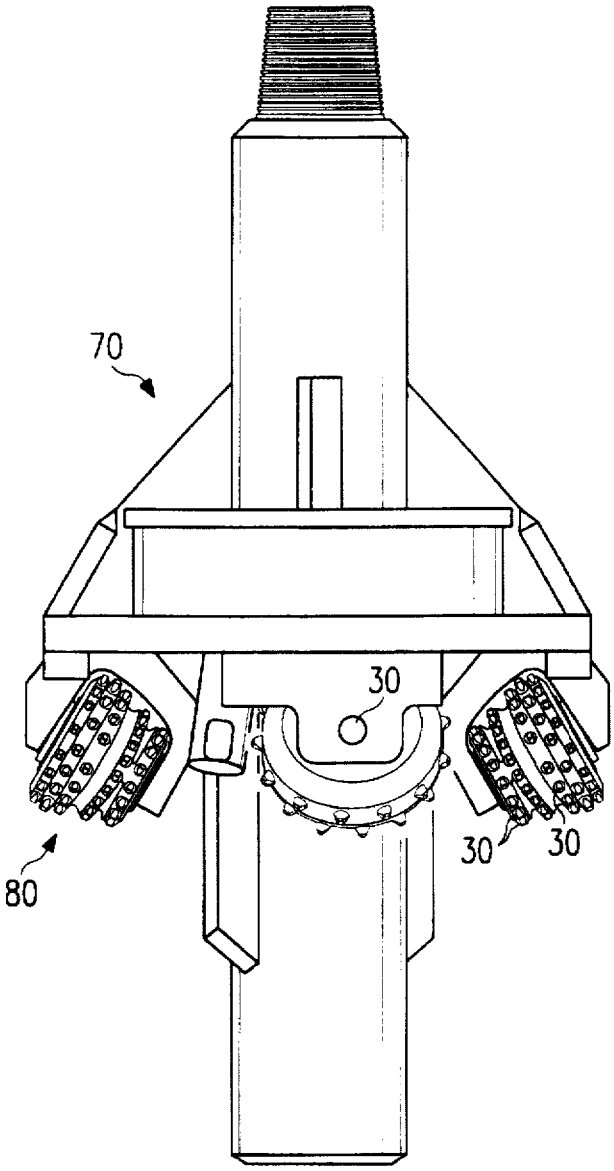
FIG. 6 is a schematic drawing showing an elevational view of a hole opener having rotary cones and inserts incorporating the teachings of the present invention.
Figure 7:
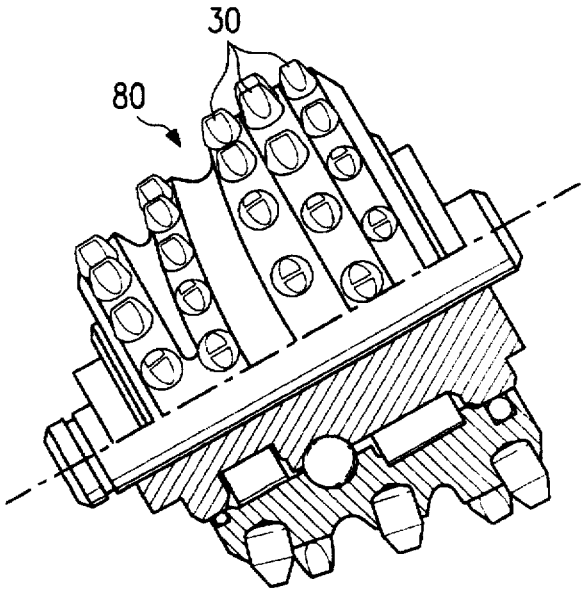
FIG. 7 is an enlarged drawing partially in section and partially in elevation showing a rotary cone associated with the hole opener of FIG. 6.

As shown in FIGS. 1 through 3, for purposes of illustration, the present invention is embodied in a rotary rock bit 10 including a bit body adapted to be connected at its pinned end to the lower end of a rotary drill string. Included within the body of the bit 10 are three substantially identical arms 18, a portion of one such arm is shown in FIG. 2. As shown in FIG. 1, the rotary rock bit 10 includes a plurality of inserts 30, each insert 30 installed into a socket 40. Each of the inserts 30 shown can incorporate the concepts of the present invention. FIGS. 6 and 7 show a hole opener 70 and its associated rotary cones 80 that can also have inserts 30 that incorporate the concepts of the present invention. Herein the term insert will be used to describe any element of a rock drill bit 10, hole opener 70, or like drilling device, where the element is installed into a socket 40 and retained in socket 40 due to the interference between the element and the socket wall.

As shown in FIG. 2, the lower portion of the arm 18 is provided with a conventional bearing pin or shaft 14 upon which a generally conical cutter cone 22 is rotatably mounted. The cutter cone 22 rotates about axis 12 that tilts downwardly and inwardly at an angle toward a rotational axis 11 of the bit. FIG. 2 also shows a plurality of various inserts 30 installed into sockets 40. For cutting the bottom of the borehole, a plurality of cutting inserts 24 protrude outwardly from the surface 16 of the cutter cone 22. The rock drill bit 10 can include a variety of inserts 30, such as, for example, surf inserts 26, shirttail buttons 28, and cutting inserts 24 that can incorporate the concepts of the present invention.

Figure 8:
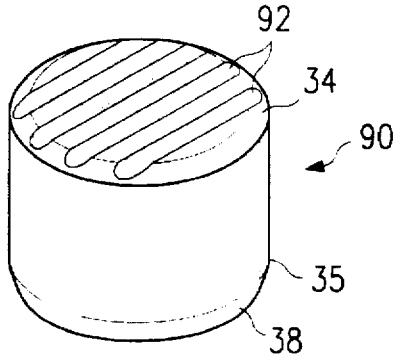
FIG. 8 is a schematic drawing showing an isometric view of an insert having polycrystalline diamond cutting surfaces incorporating the teachings of the present invention.

FIG. 3 shows an example of an insert 30 incorporating the teachings of the present invention. Insert 30 has a cylindrical body 32 integrally formed with a generally conical shaped extension 34 and a lower portion 38. As shown in FIG. 2, the cylindrical body 32 connects to the body 25 of the cutter cone 22 by a press fit into a correspondingly shaped socket 40. Preferably, but not necessarily, the body of the insert is of a generally cylindrical shape, meaning that it may be truly cylindrical in shape, or of a similar shape having an oblong or oval-sectional configuration. The insert 30 of FIG. 3, by way of example only, represents a cutting insert 24 that includes conically shaped extension 34 that intersects the generally cylindrical body 32 at ridge 36. When the cutting insert 24 is mounted in the socket 40 in the cone body 25, the ridge 36 substantially coincides with the edge of the socket. The extension 34 is not critical to the function of the present invention. Other types of inserts 30 may have different extensions 34 or no extension at all. For example, the shirttail button 28 shown in FIG. 2, does not have a cylindrical extension 34. FIG. 8 shows an isometric view of an insert 30 having polycrystalline diamond cutting surfaces 92 for use in a hole opener 70. Insert 30 of FIG. 8 also includes lower portion 38 that incorporates the teachings of the present invention.

As shown in FIG. 3, lower portion 38 has a generally frustoconical shape from the intersection 35 between the cylindrical body 32 and the lower portion 38 to the flat portion 60 (shown in FIG. 5) at the lowest point of insert 30. Lower portion 38 provides the first contact point between insert 30 and socket 40 as an insert 30 is pressed into a socket 40. The exterior surface of lower portion 38 includes lead-in surface 54, blend surface 56, chamfer surface 58 and flat surface 60 as shown in FIG. 5.

Figure 4:
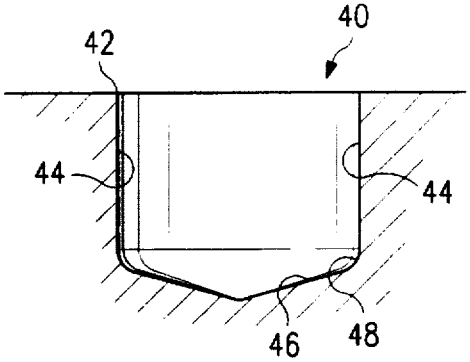
FIG. 4 is a schematic drawing in section with portions broken away showing an open socket satisfactory for receiving the insert of FIG. 3.

FIG. 4 shows socket 40 without an insert 30 installed. The socket 40 can be drilled into any portion of drill bit 10 where an insert is required. Socket 40 is drilled to generally conform with the shape of the insert 30 to be installed. For an insert 30 having a cylindrical body 32, socket 40 will be formed with a cylindrical cavity having a diameter slightly smaller than the insert body 32 diameter to provide a retention force on an installed insert 30 due to the force between the insert 30 and the socket walls 44. This interference fit will provide a force that will hold the insert 30 in the socket 40 during drilling operation. Socket 40 can include a conical bottom 46 upon which the lower portion 38 of insert 30 will rest. The transition surface 48 forms the transition from the cylindrical portion of socket 40 to the conical bottom portion 46 of socket 40.

Figure 5:
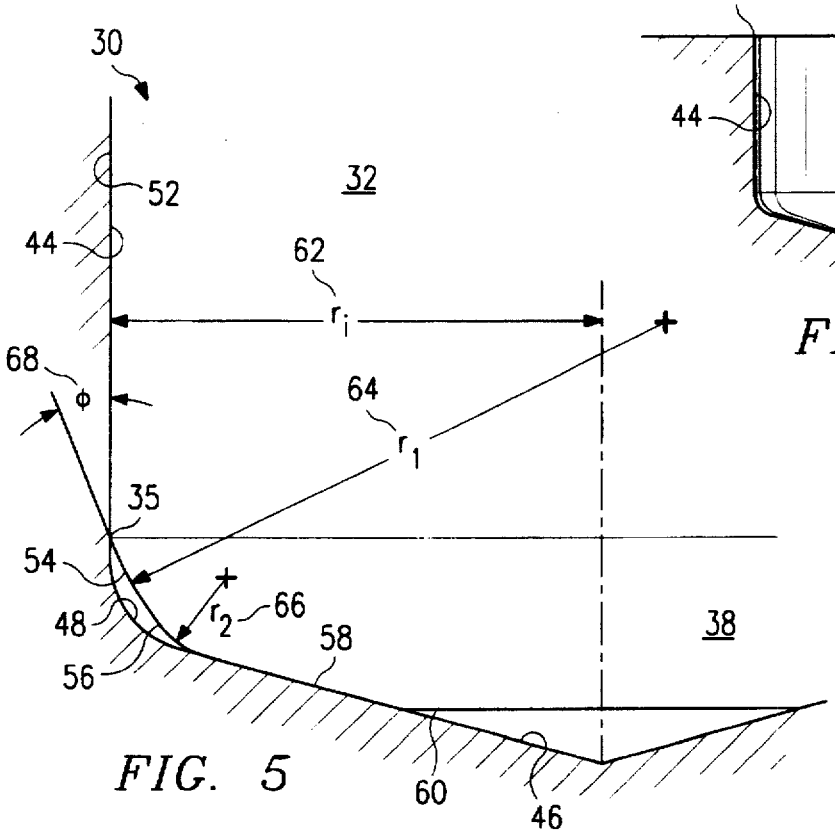
FIG. 5 is an enlarged drawing in section with portions broken away showing the insert of FIG. 3 installed within the socket of FIG. 4.

FIG. 5 shows an insert 30 installed into a socket 40. The exterior surface of insert 30 transitions from exterior surface 52 of cylindrical body 32 to lead-in surface 54 to blend surface 56 to chamfer surface 58 to flat surface 60 at the bottom of insert 30. As shown in FIG. 5, cylindrical body surface 52 contacts socket wall 44 to form the interference fit that retains insert 30 within socket 40 during drilling operation, while chamfer surface 58 rests on the bottom of socket wall 44. As shown in FIG. 5, lead-in surface 54 and blend surface 56 preferably will not contact the socket wall 44, however, socket 40 could be formed such that socket wall 44 contacts one or both of these surfaces.

With continued reference to FIG. 5, cylindrical body 32 of insert 30 has a radius 62 labelled $r_i$. Exterior surface 52 extends substantially parallel with the vertical centerline of the insert 30 according to radius 62. Lead-in surface 54 begins at the intersection 35 between the cylindrical body 32 and lower portion 38. The shape of lead-in surface 54 is defined by a lead-in radius 64 labelled $r_1$. Thus, lead-in surface 54 will necessarily be a convex curved surface according to the arc of lead-in radius 64. Lead-in surface 54 will provide the portion of insert 30 that first contacts socket edge 42 (shown in FIG. 4) during the pressing installation of insert 30 into socket 40. This is because insert cylindrical body 32 has a slightly larger diameter than the entry 42 of socket 44 (due to the need for an interference fit). The curved lead-in surface 54, as defined by lead-in radius 64, will provide a smoother entrance of insert 30 into socket 40 during installation as compared to a straight chamfer lead-in surface. This smoother entrance can reduce damage to the socket wall 44 during installation of insert 30, and provide better retention of insert 30 within socket 40 during operation.

The tangent of the arc formed by lead-in radius 64 at intersection 35 forms lead-in angle $\phi$, labeled 68. Lead-in radius 64 should be large enough so that lead-in angle 68 is less than 15 degrees. A lead-in angle 68 of approximately 12.5 degrees will provide the advantages embodied within the present invention. Lead-in radius 64 is preferably larger than insert radius 62, and can be larger than the diameter of insert 30. It should be further understood that transition portion 48 of socket 40 should be defined by a radius less than or equal to lead-in radius 64.

The curved lead-in surface 54 may be formed on the insert when the insert 30 is molded. The punch tool used to make the bottom portion of the insert will preferably have the curved lead-in surface cut into the tool. In conventional compact manufacturing, when the cylindrical surface of an insert is ground, a burr or raised edge may form on the angled lead-in chamfer. The curved lead-in surface 54 will have a significantly smaller angle to reduce the likelihood of a burr forming during grinding. This eliminates the need for tumbling to remove these burrs. This also eliminates damage to the socket walls caused by a burr during socket installation.

Blend radius 66, labelled $r_2$, defines the shape of blend surface 56. Blend surface 56 will be a convex curved surface according to the arc of blend radius 66. Blend surface 56 is used to transition from lead-in surface 54 to chamfer surface 58. Blend radius 66 should be smaller than insert radius 62 (and can be considerably smaller). Blend surface 56 can help to initially position insert 30 within socket 40 prior to installation, but blend surface 56 should preferably not contact socket edge 42 during the actual press installation process. Blend surface 56 transitions to chamfer surface 58, which has an angle greater than the lead-in angle 68 with respect to exterior surface 52. Chamfer surface 58, as shown in FIG. 5, coincides with conical bottom 46 of socket 40. Chamfer surface 58 transitions to flat surface 60 formed approximately perpendicular to exterior surface 52.

The punch tool used to make the bottom portion of the insert will preferably have a blend surface and a chamfer surface cut into the tool. The powder added into the punch will take the form of the insert's bottom when pressure is applied to the powder.

The embodiment described in FIG. 5 is illustrative to show an insert 30 having a lead-in surface 54 defined by the lead-in radius 64 with a blend surface 56, a chamfer surface 58, and a flat bottom surface 60. In an alternative embodiment, the insert 30 need not have both a chamfer surface 58 and a flat bottom surface 60. The blend radius surface 56 could transition to one or the other of these two surfaces. In another embodiment, the insert 30 need not have a blend surface 56, in which case the lead-in surface 54 would transition directly to a chamfer surface 58 or flat bottom surface 60.

In view of the foregoing, it will be seen that the present invention brings to the art a new and improved roller cone bit 10 having inserts 30 that provide a smoother entrance of insert 30 into socket 40 during installation as compared to previous lead-in surfaces. Advantageously, this is accomplished by reason of the curved lead-in surface 54, defined by a large lead-in radius 64, that provides a smaller lead-in angle 68 and a smoother lead-in surface 54. The smoother entrance of the insert 30 into socket 40 can reduce damage to the socket wall 44 during installation of insert 30. By reducing damage to the socket wall 44, the present invention can more effectively maintain the integrity of the socket 40, resulting in enhanced retention of the insert 30 within the socket 40. The lead-in surface 54 may also provide a better draft and increase the ease of purposeful removal of an insert 30 when pulling the insert from the mold during manufacture of the insert 30.

The present invention's use of a sufficiently large lead-in radius 64 when defining the shape of the lead-in surface 54 to result in a smaller lead-in angle 68. This smaller lead-in angle 68 can reduce both the occurrence and the size of defects, such as steps or lips, at the intersection 35 of the cylindrical body 32 to the lower insert portion 38. These defects can interfere with the installation, retention, and removal of inserts 30. By eliminating these intersection area defects, the present invention also eliminates the need to perform a tumbling process (and the subsequent cleaning process) on the inserts 30 to remove protrusions and sharp edges.

Although the present invention and its advantages have been described in detail, it should be understood that various changes, substitutions, and alterations can be made therein without departing from the spirit and scope of the invention as defined by the following claims.

What is claimed is:

1. A drill bit comprising:

a bit body having at least one arm connected thereto and depending from said body;

a bearing pin attached to said arm;

a cutter attached to said pin and rotatable on said pin for forming a borehole in the earth;

a plurality of sockets formed in said bit body, one socket for each of a plurality of inserts, and each of said sockets having an opening to receive a respective insert with a press fit, each of said sockets formed with a shape to conform generally with said respective insert to be received within said socket;

the plurality of inserts respectively disposed in each of said sockets, each insert retained in said respective socket by means of interference forces associated with said press fit between said socket and said insert, each of said inserts further comprising a generally cylindrical body having a radius which defines in part a cylindrical body surface for each of said inserts that transitions to a respective lead-in surface;

said lead-in surface formed on a lower portion of each insert, each lead-in surface comprising a convex curved surface defined by a lead-in radius, said lead-in radius being longer than said radius of said generally cylindrical body;

said lead-in radius having a sufficient length such that, at an intersection between said cylindrical body surface and said lead-in surface, a tangent of an arc formed by said lead-in radius defines a lead-in angle of less than fifteen degrees relative to said cylindrical body surface;

a blend surface defined by a blend radius, said blend radius having a length less that said radius of said generally cylindrical body; and a chamfer surface formed with an angle relative to said cylindrical body surface greater than said lead-in angle, said chamfer surface forming a bottom portion of said insert, and wherein said lead-in surface transitions to said blend surface and said blend surface transitions to said chamfer surface.

2. A drill bit comprising:

a bit body having at least one arm connected thereto and depending from said body;

a bearing pin attached to said arm;

a cutter attached to said pin and rotatable on said pin for forming a borehole in the earth;

a plurality of sockets formed in said bit body, one socket for each of a plurality of inserts, and each of said sockets having an opening to install one of said inserts with a press fit, each of said sockets formed with a shape to conform generally with said one insert to be installed within said socket;

the plurality of inserts installed respectively in each of said sockets, each insert retained in said respective socket by means of interference forces associated with said press fit between said insert and said socket, each of said inserts further comprising a generally cylindrical body having a radius which defines in part a cylindrical body surface for each of said inserts with said cylindrical body surface transitioning to a respective lead-in surface;

said lead-in surface formed on a lower portion of each insert, each lead-in surface comprising a convex curved surface defined by a lead-in radius, said lead-in radius being longer than said radius of said generally cylindrical body;

said lead-in radius having a sufficient length such that, at an intersection between said cylindrical body surface and said lead-in surface, a tangent of an arc formed by said lead-in radius defines a lead-in angle of less than fifteen degrees relative to said cylindrical body surface;

a blend surface defined by a blend radius, said blend radius having a length less that said radius of said generally cylindrical body;

a chamfer surface formed with an angle relative to said cylindrical body surface greater than said lead-in angle, said chamfer surface forming a bottom portion of said insert; and a flat surface generally perpendicular to said cylindrical body surface, said flat surface forming another bottom portion of said insert, and wherein said lead-in surface transitions to said blend surface, said blend surface transitions to said chamfer surface, and said chamfer surface transitions to said flat surface.

3. An insert for use in a drilling device, said insert having a generally cylindrical body with a radius defining in part a cylindrical body surface, said insert adapted to be mounted on said drilling device within a socket formed in said drilling device and a lead-in surface formed on a lower portion of said insert, said lead-in surface comprising a convex curved surface defined in part by a lead-in radius, said lead-in radius being longer than said radius of said generally cylindrical body.

4. The insert of claim 3 wherein said lead-in radius has a sufficient length such that, at an intersection between said cylindrical body surface and said lead-in surface, a tangent of an arc formed by said lead-in radius forms an angle less than fifteen degrees relative to said cylindrical body surface.

5. The insert of claim 3 further comprising a flat surface generally perpendicular to said cylindrical body surface, said flat surface forming a bottom of said insert, and wherein said lead-in surface transitions to said flat surface.

6. The insert of claim 3 further comprising a chamfer surface formed with an angle relative to said cylindrical body surface greater than said lead-in angle, said chamfer surface forming a bottom of said insert, and wherein said lead-in surface transitions to said chamfer surface.

7. The insert claim 3 further comprising;

a flat surface generally perpendicular to said cylindrical body surface, said flat surface forming a bottom portion of said insert, and a chamfer surface formed with an angle relative to said cylindrical body surface greater than said lead-in angle, and wherein said lead-in surface transitions to said chamfer surface and said chamfer surface transitions to said flat surface.

8. The insert claim 3 further comprising a blend surface defined by a blend radius, said blend radius having a length less that said radius of said generally cylindrical body, and wherein said lead-in surface transitions to said blend surface.

9. An insert for use in a drilling device, said insert having a generally cylindrical body with a radius defining a cylindrical body surface, said insert adapted to be mounted on said drilling device within a socket formed in said drilling device and a lead-in surface formed on a lower portion of said insert, said lead-in surface comprising a convex curved surface defined in part by a lead-in radius, said lead-in radius being longer than said radius of said generally cylindrical body;

said lead-in radius has a sufficient length such that, at an intersection between said cylindrical body surface and said lead-in surface, a tangent of an arc formed by said lead-in radius defines an angle approximately less than fifteen degrees relative to said cylindrical body surface;

a blend surface defined by a blend radius, said blend radius having a length less that said radius of said generally cylindrical body; and a chamfer surface formed with an angle relative to said cylindrical body surface greater than said lead-in angle, said chamfer surface forming a bottom of said insert, and wherein said lead-in surface transitions to said blend surface and said blend surface transitions to said chamfer surface.

10. An insert for use in a drilling device, said insert having a generally cylindrical body with a radius defining a cylindrical body surface, said insert adapted to be mounted on said drilling device within a socket formed in said drilling device and a lead-in surface formed on a lower portion of said insert, said lead-in surface comprising a convex curved surface defined in part by a lead-in radius, said lead-in radius being longer than said radius of said generally cylindrical body;

a blend surface defined by a blend radius, said blend radius having a length less that said radius of said generally cylindrical body;

a chamfer surface formed with an angle relative to said cylindrical body surface greater than said lead-in angle, said chamfer surface forming a bottom portion of said insert; and a flat surface generally perpendicular to said cylindrical body surface, said flat surface forming a bottom portion of said insert, and wherein said lead-in surface transitions to said blend surface, said blend surface transitions to said chamfer surface, and said chamfer surface transitions to said flat surface.

11. In a drilling device having a cone cutter rotatably mounted on a shaft, said drilling device having a plurality of generally cylindrical inserts installed within respective sockets within said drilling device and each of said inserts having a generally cylindrical body defined in part by a radius, the improvement comprising:

a lead-in surface formed on each of said plurality of inserts, each lead-in surface comprising a convex curved surface defined by a lead-in radius, said lead in radius being longer than said radius of said generally cylindrical body.

12. A drill bit for use in forming a borehole in the earth comprising:

a bit body having at least one arm connected thereto and depending from said bit body;

a bearing pin attached to said arm;

a cutter attached to said bearing pin and rotatably mounted on said bearing pin for forming said borehole;

a plurality of sockets formed in said drill bit with each of said sockets corresponding respectively with a plurality of inserts;

an opening in each of said sockets for installing one of said inserts with a press fit;

each of said sockets formed with a shape to conform generally with said insert to be installed within said socket;

said plurality of inserts installed respectively in said sockets with each insert retained in its respective socket by interference forces associated with said press fit between said socket and said insert, each of said inserts further comprising:

a generally cylindrical body having a radius which defines in part a generally cylindrical body surface on each of said inserts and said generally cylindrical body surface transitions to a respective lead-in surface; and said lead-in surface formed on a lower portion of each insert comprising a convex, curved surface defined by a lead-in radius, said lead-in radius being longer than said radius of said generally cylindrical body.

13. The drill bit of claim 12 wherein said lead-in radius has a sufficient length such that, at an intersection between said cylindrical body surface and said lead-in surface, the tangent of an arc formed by said lead-in radius defines above-identified in angle of less than fifteen degrees relative to said cylindrical body surface.

14. The drill bit of claim 13 wherein each insert further comprises a flat surface generally perpendicular to said cylindrical body surface, said flat surface forming a bottom of said insert, and wherein said lead-in surface transitions to said flat surface.

15. The drill bit of claim 13 wherein each insert further comprises a chamfer surface formed with an angle relative to said cylindrical body surface greater than said lead-in angle, said chamfer surface forming a bottom of said insert, and wherein said lead-in surface transitions to said chamfer surface.

16. The drill bit of claim 13 wherein each insert further comprises:

a flat surface generally perpendicular to said cylindrical body surface, said flat surface forming a bottom of said insert; and a chamfer surface formed with an angle relative to said cylindrical body surface greater than said lead-in angle, and wherein said lead-in surface transitions to said chamfer surface and said chamfer surface transitions to said flat surface.

17. The drill bit of claim 12 wherein each insert further comprises a blend surface defined by a blend radius, said blend radius having a length less that said radius of said insert, and wherein said lead-in surface transitions to said blend surface.

* * * * *